US009169093B2

(12) United States Patent
Aoyama

(10) Patent No.: US 9,169,093 B2
(45) Date of Patent: Oct. 27, 2015

(54) IMAGE FORMING APPARATUS

(71) Applicant: Brother Kogyo Kabushiki Kaisha, Nagoya-shi, Aichi-ken (JP)

(72) Inventor: Masanori Aoyama, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/291,062

(22) Filed: May 30, 2014

(65) Prior Publication Data

US 2014/0353901 A1 Dec. 4, 2014

(30) Foreign Application Priority Data

May 31, 2013 (JP) ..... 2013-116204

(51) Int. Cl.

| | |
|---|---|
| ***B65H 29/70*** | (2006.01) |
| ***B65H 29/52*** | (2006.01) |
| ***B65H 5/26*** | (2006.01) |
| ***B65H 5/06*** | (2006.01) |
| ***B65H 9/00*** | (2006.01) |
| ***B41J 3/60*** | (2006.01) |
| ***B65H 29/22*** | (2006.01) |

(52) U.S. Cl.

CPC ... *B65H 5/26* (2013.01); *B41J 3/60* (2013.01); *B65H 5/062* (2013.01); *B65H 9/00* (2013.01); *B65H 29/22* (2013.01); *B65H 29/52* (2013.01); *B65H 29/70* (2013.01)

(58) Field of Classification Search

CPC ..... B65H 29/70; B65H 29/52; B65H 29/22

USPC ..... 271/188, 209

See application file for complete search history.

(56) References Cited

U.S. PATENT DOCUMENTS

| | | | | |
|---|---|---|---|---|
| 5,194,904 | A * | 3/1993 | Ruch | 399/397 |
| 5,312,108 | A * | 5/1994 | Hayashi | 271/188 |
| 6,698,752 | B1 | 3/2004 | Kakuta et al. | |
| 8,523,175 | B2 * | 9/2013 | Kobayashi et al. | 271/188 |
| 8,708,481 | B2 | 4/2014 | Ito et al. | |
| 8,800,987 | B2 * | 8/2014 | Kimura et al. | 271/188 |
| 2013/0135411 | A1 | 5/2013 | Ito et al. | |

FOREIGN PATENT DOCUMENTS

| | | | |
|---|---|---|---|
| JP | H05-43110 | A | 2/1993 |
| JP | 2000-264525 | A | 9/2000 |
| JP | 2003-054813 | A | 2/2003 |

(Continued)

*Primary Examiner* — Luis A Gonzalez

(74) *Attorney, Agent, or Firm* — Banner & Witcoff, Ltd.

(57) ABSTRACT

An image forming apparatus includes an image forming unit, a first guide, a switchback roller, a second guide, and a corrugation member. The corrugation member has a shape for producing a recessed portion and a ridge portion in a sheet. The second guide has a first guide surface and a second guide surface disposed to contact the recessed portion and the ridge portion of the sheet, respectively. As viewed from a downstream side of the switchback roller in a sheet ejection direction along a tangent to the switchback roller at a nip position, a distance between an end of the first guide closest to the switchback roller and an end of the second guide surface closest to the switchback roller is greater than a distance between the end of the first guide closest to the switchback roller and an end of the first guide surface closest to the switchback roller.

12 Claims, 7 Drawing Sheets

(56) References Cited

FOREIGN PATENT DOCUMENTS

| | | | | |
|---|---|---|---|---|
| JP | 2007-230746 | A | | 9/2007 |
| JP | 2008-019080 | A | | 1/2008 |
| JP | 2008-222407 | A | | 9/2008 |
| JP | 2010228893 | A | * | 10/2010 |
| JP | 2011-136792 | A | | 7/2011 |
| JP | 2011-136803 | A | | 7/2011 |
| JP | 2013-111838 | A | | 6/2013 |

* cited by examiner

IMAGE FORMING APPARATUS

CROSS REFERENCE TO RELATED APPLICATION

This application claims priority from Japanese Patent Application No. 2013-116204, filed on May 31, 2013, which is incorporated herein by reference in its entirety.

TECHNICAL FIELD

Aspects of the disclosure relate to an image forming apparatus of electrophotographic type.

BACKGROUND

An image forming apparatus, e.g., a printer, which is configured to print images on both sides of a sheet, is known.

The printer is configured to change a status of the sheet between when the sheet is ejected from the main body of the printer and stacked and when the sheet is fed back into the main body.

Specifically, the printer includes a corrugation protrusion and a corrugation changing mechanism, which are disposed in proximity to a sheet ejection port. The corrugation protrusion protrudes toward a sheet feed path to corrugate the sheet passing through the sheet feed path. The corrugation changing mechanism is configured to move the sheet feed path such that an amount of the corrugation protrusion protruding toward the sheet feed path varies. When a sheet is ejected from the main body, the corrugation changing mechanism causes the corrugation protrusion to protrude toward the sheet feed path to contact the sheet such that the sheet is corrugated to have increased stiffness. Thus, the sheet can be prevented from being ejected while being curled and the ejected sheet can be stacked neatly. The stiffness of a sheet is a force of the sheet to maintain its original state without bending easily, that is, the tension of the sheet. When the sheet is feed back into the main body, the corrugation changing mechanism changes a feed path of the sheet to be fed such that the sheet does not contact the corrugation protrusion, in other words, the sheet is not corrugated or not given stiffness. This structure reduces, in a path for printing a second side of a sheet, noise caused by contact of the sheet to the main body and damage to the sheet slidingly contacting the main body.

SUMMARY

However, the printer described above needs to change the stiffness of the sheet between when the sheet is ejected from the main body and stacked and when the sheet is fed back into the main body. Thus, the corrugation changing mechanism needs to adjust an amount of protrusion of the corrugation protrusion to the sheet feed path, which results in complicated structure of the printer.

The printer is structured such that, when the sheet is fed back into the main body, the sheet is not given stiffness. Depending on where the path for printing the second side of the sheet is provided, the sheet may need to be corrugated to have increased stiffness when the sheet is fed back into the main body. In this case, noise caused by contact of the sheet to the main body and damage to the sheet slidingly contacting the main body may occur.

Illustrative aspects of the disclosure provide an image forming apparatus configured to reduce resistance to a sheet fed to a re-feed path in a simplified structure.

According to an aspect of the disclosure, an image forming apparatus includes an image forming unit configured to form an image on a sheet, a first guide configured to guide the sheet having the image formed by the image forming unit, a switchback roller configured to rotate in a forward direction in which the sheet is ejected in a sheet ejection direction and in a backward direction in which the sheet is fed in a switchback direction, a second guide configured to guide the sheet guided by the first guide toward the switchback roller in the sheet ejection direction, the second guide being further configured to guide the sheet being fed in the switchback direction from the switchback roller toward a re-feed path for re-feeding the sheet toward the image forming unit, and a corrugation member including a nip portion configured to contact the switchback roller and a protruding portion protruding toward the switchback roller relative to the nip portion. The corrugation member has a shape for producing, in the sheet being fed, a recessed portion and a ridge portion as viewed from a downstream side of the switchback roller in the sheet ejection direction along a tangent to the switchback roller at a nip position where the nip portion of the corrugation member and the switchback roller nip the sheet therebetween. The second guide has a first guide surface disposed to contact the recessed portion of the sheet fed in the switchback direction, and a second guide surface spaced apart from the first guide surface at least in an axial direction of the switchback roller, the second guide surface being configured to contact the ridge portion of the sheet fed in the switchback direction. As viewed from the downstream side of the switchback roller in the sheet ejection direction along the tangent to the switchback roller at the nip position, a distance between an end of the first guide closest to the switchback roller and an end of the second guide surface closest to the switchback roller is greater than a distance between the end of the first guide closest to the switchback roller and an end of the first guide surface closest to the switchback roller.

With this structure, after an image is formed on a sheet by the image forming unit, the sheet is guided by the first guide and the second guide in this order and fed to the switchback roller in the sheet ejection direction. At this time, the sheet fed by the switchback roller is corrugated to have a recessed portion and a ridge portion

BRIEF DESCRIPTION OF THE DRAWINGS

Illustrative aspects will be described in detail with reference to the following figures in which like elements are labeled with like numbers and in which.

DETAILED DESCRIPTION

A first embodiment of the disclosure will be described.

Figure 1:
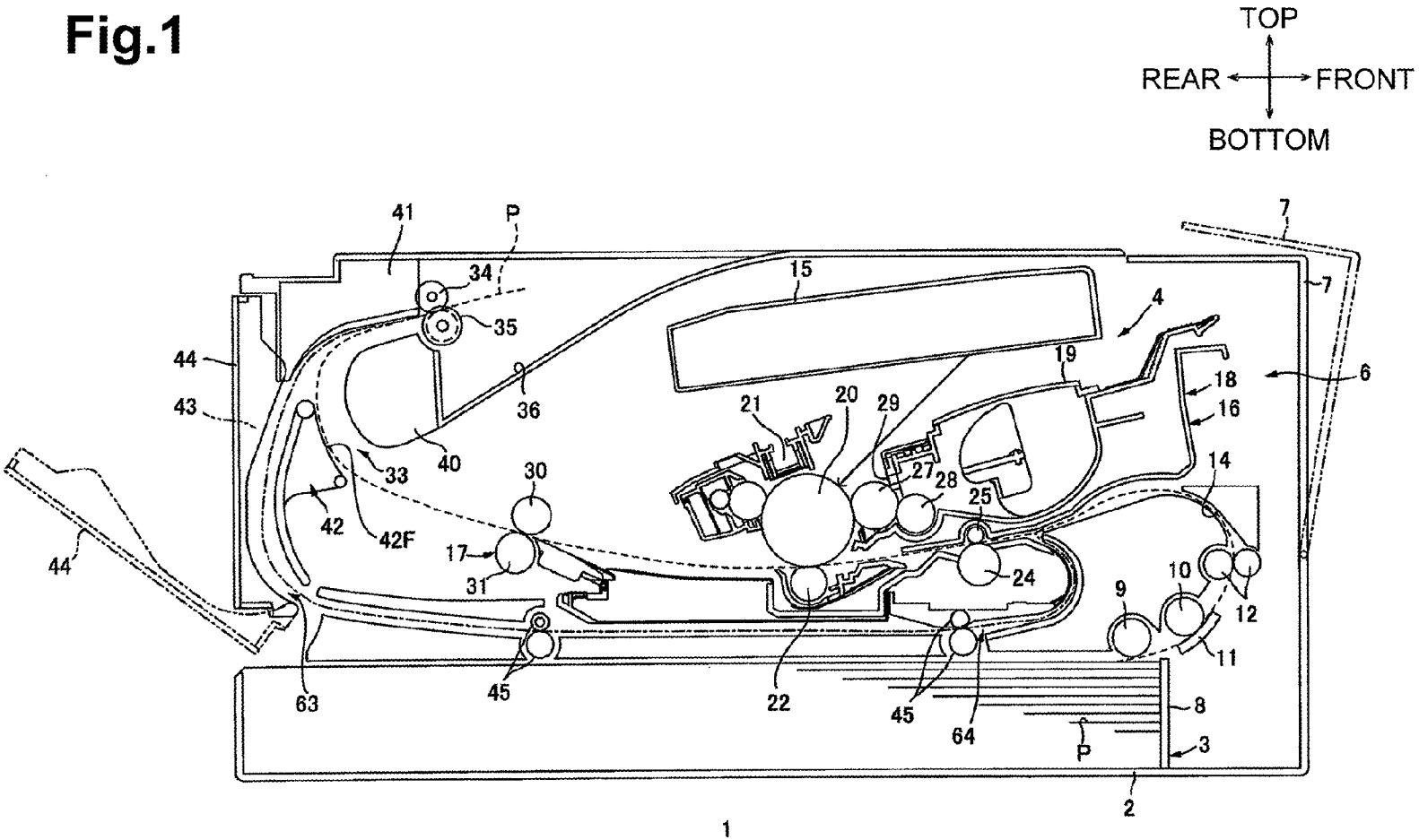
FIG. 1 illustrates an internal structure of a printer according to a first illustrative embodiment.

As shown in FIG. 1, a printer 1 as an example of an image forming apparatus is an electrophotographic monochrome printer. The printer 1 includes a main casing 2 as an example of a main body.

The main casing 2 is substantially box shaped. The main casing 2 includes, in its internal space, a sheet supply unit 3 for supplying a recording medium, e.g., a sheet P, and an image forming unit 4 for forming an image on the sheet P supplied thereto.

In the following description, orientations or sides of the printer 1 will be identified based on the printer 1 disposed horizontally. In other words, in FIG. 1, the up side is referred to as the top or upper side of the printer 1, the down side is referred to as the bottom or lower side of the printer 1, the left side is referred to as the rear or rear side of the printer 1, and the right side is referred to as the front or front side of the printer 1. When the printer 1 is viewed from the front side, the side on the left is referred to as the left or left side of the printer 1 and the side on the right is referred to as the right or right side of the printer 1.

The main casing 2 has a cartridge opening 6 and includes a front cover 7.

The cartridge opening 6 is disposed through a front wall of the main casing 2 in the front-rear direction, and allows a process cartridge 16 to pass therethrough.

The front cover 7 is configured to pivot about its lowest point between a closed position where the cartridge opening 6 is closed, shown by a solid line in FIG. 1, and an open position where the cartridge opening 6 is open, shown by a phantom line in FIG. 1.

The sheet supply unit 3 is disposed in a lower portion of the main casing 2. The sheet supply unit 3 includes a sheet supply tray 8 configured to store sheets P therein, a pickup roller 9 disposed above the front end of the sheet supply unit 3, and a separation roller 10 and a separation pad 11 disposed opposite to each other in front of the pickup roller 9.

The sheet supply unit 3 includes a pair of supply rollers 12 disposed opposite to each other above the separation pad 11, a sheet supply path 14 extending from a nip between the pair of supply rollers 12 toward the upper rear side, and a main body-side register roller 24 disposed at the rear of the sheet supply path 14.

The image forming unit 4 includes a scanner unit 15, a process cartridge 16, and a fixing unit 17.

The scanner unit 15 is disposed in an upper portion of the main casing 2. The scanner unit 15 is configured to emit a laser beam shown by a solid line toward a photosensitive drum 20 based on image data to expose the photosensitive drum 20 to light.

The process cartridge 16 is detachably attachable to the main casing 2 and is disposed below the scanner unit 15 and the above the sheet supply unit 3.

The process cartridge 16 includes a drum cartridge 18 configured to be attached to and removed from the main casing 2, and a developing cartridge 19 configured to be attached to and removed from the drum cartridge 18.

The drum cartridge 18 includes a photosensitive drum 20, a scorotron charger 21, and a transfer roller 22.

The photosensitive drum 20 is shaped like a cylinder extending in the left-right direction, and rotatably supported in a rear portion of the drum cartridge 18.

The scorotron charger 21 is supported by the drum cartridge 18 such that it is disposed above the photosensitive drum 20.

The transfer roller 22 is shaped like a cylinder extending in the left-right direction, rotatably supported in the rear portion of the drum cartridge 18, and pressed against a lower end of the photosensitive drum 20.

The drum cartridge 18 further includes a process-side register roller 25.

The process-side register roller 25 is shaped like a cylinder extending in the left-right direction, rotatably supported at a lower end in substantially a center, in the front-rear direction, of the drum cartridge 18, and contacts the upper end of the main body-side register roller 24.

The developing cartridge 19 stores toner in its internal space. The developing cartridge 19 includes a developing roller 27, a supply roller 28, and a layer thickness regulating blade 29.

The developing roller 27 is shaped like a cylinder extending in the left-right direction, and rotatably supported at a rear end portion of the developing cartridge 19 such that a rear portion of the developing roller 27 is exposed. The developing roller 27 is pressed against the front end portion of the photosensitive drum 20.

The supply roller 28 is rotatably supported at the rear end portion of the developing cartridge 19. The developing roller 28 contacts the front end portion of the developing roller 27.

The upper end portion of the layer thickness regulating blade 29 is supported at the upper rear end portion of the developing cartridge 19 and the lower end portion of the layer thickness regulating blade 29 contacts the upper front end portion of the developing roller 27.

The fixing unit 17 is disposed at the rear of the process cartridge 16. The fixing unit 17 includes a heat roller 30 and a pressing roller 31 configured to be pressed against the lower rear end of the heat roller 30.

Toner is supplied from the developing cartridge 19 to the supply roller 28 and then to the developing roller 27. The toner is positively charged between the supply roller 28 and the developing roller 27 by friction.

The toner supplied to the developing roller 27 is regulated by the layer thickness regulating blade 29 along with rotation of the developing roller 27 and carried on the surface of the developing roller 27 as a layer having a fixed thickness.

The surface of the photosensitive drum 20 is uniformly and positively charged by the scorotron charger 21 along with rotation of the photosensitive drum 20, and then exposed by high speed scanning of the laser beam, shown by the solid line in FIG. 1, emitted from the scanner unit 15. Then, an electrostatic latent image corresponding to an image to be formed on a sheet P is formed on the surface of the photosensitive drum 20.

When the photosensitive drum 20 further rotates, toner carried on the surface of the developing roller 27 and positively charged is supplied to the electrostatic latent image formed on the surface of the photosensitive drum 20. Thus, the electrostatic latent image on the photosensitive drum 20 is developed with the toner into a visible image or toner image carried on the surface of the photosensitive drum 20.

A few sheets P are picked up by rotation of the pickup roller 9 from stacked sheets in the sheet supply tray 8, supplied to between the separation roller 10 and the separation pad 11, and separated one by one by the separation roller 10 and the separation pad 11. A sheet P separated is fed by the supply rollers 12 such that the sheet P makes a U-turn in the sheet supply path 14 rearward, and then fed to between the main body-side register roller 24 and the process-side register roller 25.

The sheet P is fed in the process cartridge 16. The sheet P is fed to between the lower rear end portion of the developing cartridge 19 and the lower wall of the drum cartridge 18, and then fed to between the photosensitive drum 20 and the transfer roller 22.

When the sheet P passes between the photosensitive drum 20 and the transfer roller 22, the toner image carried on the photosensitive drum 20 is transferred onto the sheet P.

The toner image transferred onto the sheet P in the process cartridge 16 is fixed by heat and pressure when the sheet P passes between the heat roller 30 and the pressing roller 31.

The sheet P having the toner image fixed thereon passes through a sheet ejection path 33 such that the sheet P makes a U-turn upward and frontward, and is guided by an outer chute 41 toward between a switchback roller 34 and a corrugation roller 35. By the switchback roller 34 and the corrugation roller 35, the sheet P is ejected onto an ejection tray 36 disposed above the scanner unit 15.

The printer 1 is configured to re-feed the sheet P from the rear of the main casing 2 frontward such that an image is formed on a back side of the sheet P.

The main casing 2 includes the switchback roller 34, a plurality of, e.g., four, corrugation rollers 35 as an example of a corrugation member, an outer chute 41 as an example of a second guide, a sub chute 40, an inner chute 42, a rear cover 44 as an example of a cover, and a plurality pair of, e.g., two, reverse feed rollers 45, and has a rear opening 43.

Figure 2:
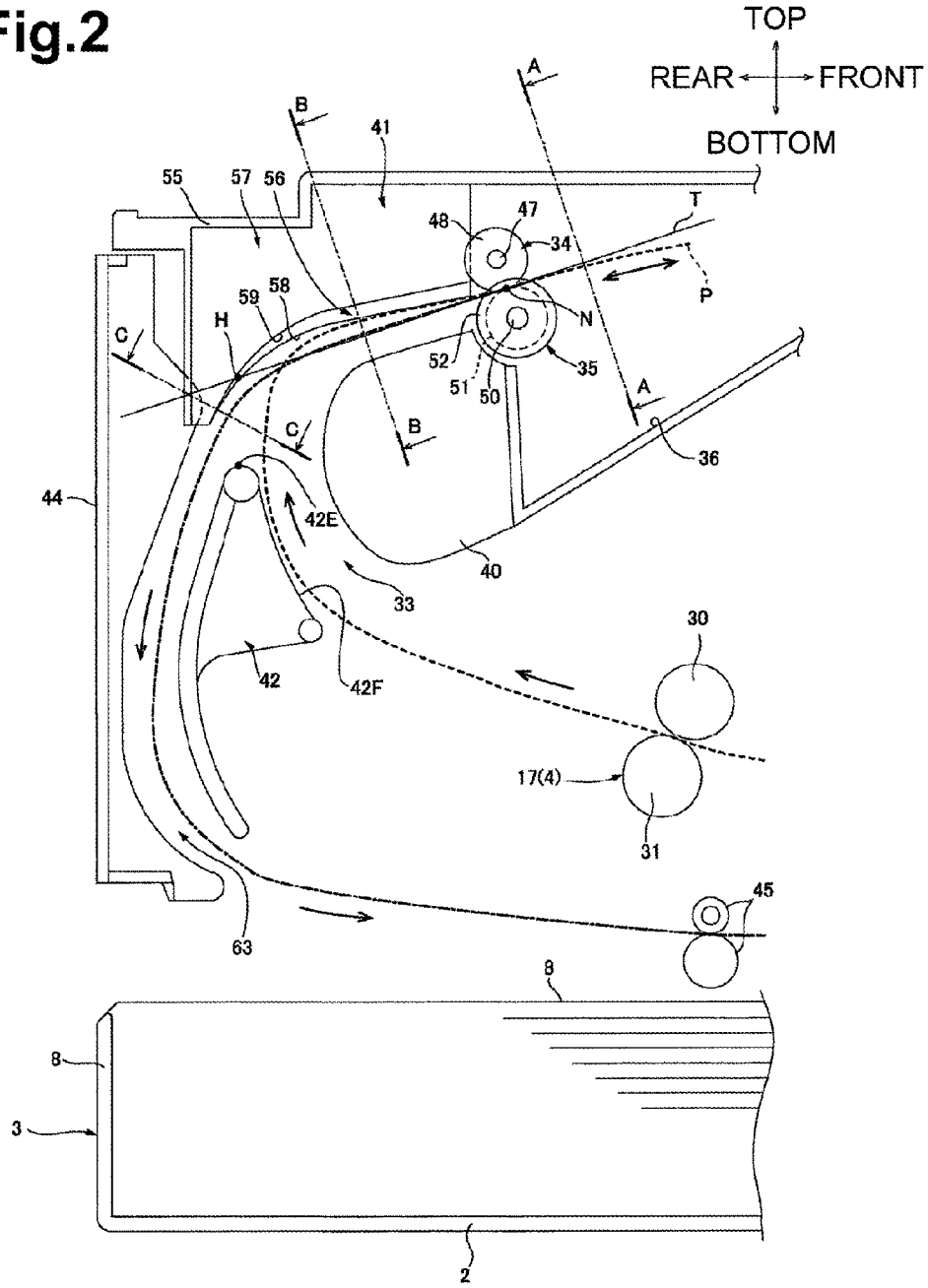
FIG. 2 is an enlarged view illustrating a principal part of a reverse feeding portion of the printer shown in FIG. 1.
Figure 3:
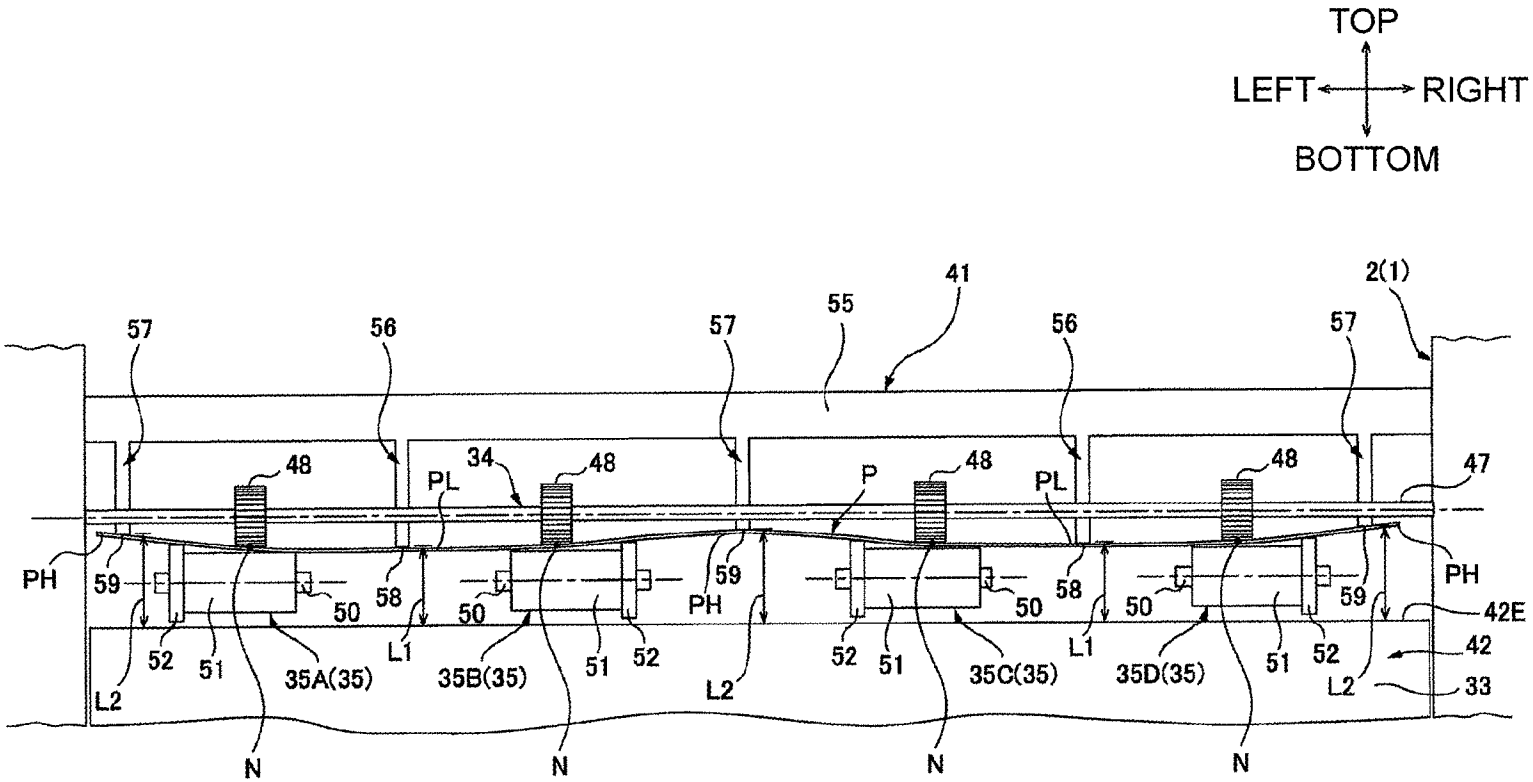
FIG. 3 is a view taken along the line A-A of FIG. 2, illustrating a state of a sheet being fed, wherein a sub chute is omitted for convenience sake.

As shown in FIG. 2, the switchback roller 34 is disposed at the upper rear end portion of the main casing 2. The switchback roller 34 is configured to rotate in a forward direction in which the sheet P is fed toward the ejection tray 36 in a sheet ejection direction shown by a broken line in FIG. 2 and a backward direction in which the sheet P is fed back into the main casing 2 in a switchback direction shown by a dot-and-dash line in FIG. 2. As shown in FIG. 3, the switchback roller 34 includes a switchback roller shaft 47 and a plurality of, e.g., four, switchback roller main bodies 48.

The switchback roller shaft 47 is shaped like a cylinder extending in the left-right direction.

The switchback roller main bodies 48, each having a cylindrical shape, are spaced apart from each other in the left-right direction. Each of the switchback roller main bodies 48 is configured to rotate integrally with the switchback roller shaft 47.

The left and right ends of the switchback roller shaft 47 of the switchback roller 34 are rotatably supported by left and right walls of the main casing 2. The switchback roller 34 receives a drive force for a forward or backward rotation from a motor, not shown, and rotates in the forward direction such that the sheet P is fed in the sheet ejection direction or rotates in the backward direction such that the sheet P is fed in the switchback direction.

The corrugation rollers 35 are disposed below the switchback roller 34. As shown in FIG. 3, the corrugation rollers 35 are spaced apart from each other in the left-right direction. The corrugation rollers 35 are a first corrugation roller 35A, a second corrugation roller 35B, a third corrugation roller 35C, and a fourth corrugation roller 35D, in this order from the left side to the right side, which are disposed in correspondence with the four switchback roller main bodies 48.

Each of the corrugation rollers 35 includes a corrugation roller shaft 50, a corrugation roller main body 51 as an example of a nip portion, and a corrugation part 52 as an example of a protruding portion.

The corrugation roller shaft 50 is shaped like a cylinder extending in the left-right direction.

The corrugation roller main body 51 is shaped like a cylinder and covers the corrugation roller shaft 50 such that left and right ends of the corrugation roller shaft 50 are exposed. The length of the corrugation roller main body 51 is longer than the length of the switchback roller main body 48 in the left-right direction.

The corrugation part 52 is disposed on one end of the corrugation roller main body 51 in the left-right direction and shaped like a disk protruding radially. Specifically, the corrugation portion 52 is disposed on left end of the first and third corrugation rollers 35A and 35C, and on the right end of the second and fourth corrugation rollers 35B and 35D.

The left and right ends of the corrugation roller shaft 50 of each corrugation roller 35 are supported by guide members (not shown) such that the corrugation roller 35 is rotatable. The guide members (not shown) are urged by urging members (not shown), e.g., springs, thereby the corrugation roller 35 is urged upward or toward the switchback roller 34.

Thus, the central portion of the corrugation roller main body 51 in the left-right direction is pressed against the lower end of the switchback roller main body 48 of the corresponding switchback roller 34, and the corrugation roller 35 follows the rotation of the switchback roller 34.

As shown in the side view of FIG. 2, the corrugation part 52 of the corrugation roller 35 extends from below a tangent to the switchback roller 34 at a nip position where the switchback roller 34 and the corrugation roller 35 nip the sheet upward to a portion of the corrugation part 52 that contacts the sheet P such that the corrugation part 52 lies above and below the tangent. The nip position between the switchback roller 34 and the corrugation roller 35 is referred to as the nip position N and the tangent to the switchback roller 34 at the nip position N is referred to as the tangent T.

The outer chute 41 is disposed in the upper rear end portion of the main casing 2 and at the rear of the switchback roller 34. As shown in FIGS. 2 and 3, the outer chute 41 includes an outer chute main body 55, a plurality of, e.g., two, first ribs 56, and a plurality of, e.g., three, second ribs 57.

The outer chute main body 55 is shaped like a flat plate defining an outline of the upper rear end portion of the main casing 2.

The first ribs 56 are spaced apart from each other in the left-right direction. Specifically, when viewed from the downstream side of the switchback roller 34 in the sheet ejection direction along the tangent T, that is, as shown in FIG. 3, which is a view taken along the line A-A of FIG. 2, the left first rib 56 is disposed between the first corrugation roller 35A and the second corrugation roller 35B, and the right first rib 56 is disposed between the third corrugation roller 35C and the fourth corrugation roller 35D.

As shown in FIG. 2, the first rib 56 is shaped like a rectangular flat plate, in sectional view, protruding downward from the lower surface of the outer chute main body 55. The lower surface of the first rib 56 is substantially arc-shaped such that it is recessed in a direction from the lower front side toward the upper rear side. The lower surface of the first rib 56 is referred to as a first guide surface 58.

As shown in FIGS. 2 and 3, an end portion of the first guide surface 58 closest to the switchback roller 34 is disposed substantially flush with the nip position N in the vertical direction.

The second ribs 57 are spaced apart from each other in the left-right direction. Specifically, as shown in FIG. 3, the left second rib 57 is disposed to the left of the first corrugation roller 35A, the middle second rib 57 is disposed between the second corrugation roller 35B and the third corrugation roller 35C, and the right second rib 57 is disposed to the right of the fourth corrugation roller 35D. That is, the second ribs 57 are spaced apart from the first ribs 56 at least in the left-right direction.

As shown in FIG. 2, the second rib 57 is shaped like a rectangular flat plate, in a side view, protruding downward from the lower surface of the outer chute main body 55. The lower surface of the second rib 57 is substantially arc-shaped such that it is recessed in a direction from the lower front side toward the upper rear side. The lower surface of the second rib 57 is referred to as a second guide surface 59. The second guide surface 59 is spaced apart from the first guide surface 58 at least in the left-right direction.

As shown in FIGS. 2 and 3, an end portion of the second guide surface 59 closest to the switchback roller 34 is disposed above the upper end of the corrugation part 52 in the vertical direction. That is, the end portion of the second guide surface 59 closest to the switchback roller 34 is disposed above the end portion of the first guide surface 58 closest to the switchback roller 34.

As shown in FIG. 2, the first guide surface 58 and the second guide surface 59 overlap each other on a downstream side, in the switchback direction, from an intersection point H of the outer chute 41 and the tangent T. In other words, when the first guide surface 58 and the second guide surface 59 are projected in the left-right direction or an axial direction of the switchback roller 34, a curvature radius of the second guide surface 59 is greater than that of the first guide surface 58.

The sub chute 40 is disposed in the upper rear end portion of the main casing 2 and spaced downward from the front side of the outer chute 41. The sub chute 40 is shaped like a square pillar extending in the left-right direction. The rear surface of the sub chute 40 is curved such that it slightly protrudes from the front side toward the rear side.

The inner chute 42 is disposed in the rear end portion of the main casing 2, and spaced downward from the rear part of the outer chute 41 and rearward from the sub chute 40. The inner chute 42 has a shape of combination of a substantially triangular prism having the top edge extending in the left-right direction and a substantially rectangular flat plate, in a plan view, extending downward from the lower rear end of the substantially triangular prism.

The front surface of the inner chute 42 is curved such that it is slightly recessed in a direction from the upper front side toward the lower rear side. The front surface of the inner chute 42 and the rear surface of the sub chute 40 define the sheet ejection path 33. The front surface of the inner chute 42 is referred to as an inner chute front surface 42F as an example of a first guide. That is, the inner chute front surface 42F is configured to guide the sheet P onto which an image is formed by the image forming unit 4 in the sheet ejection direction toward the outer chute 41.

The rear surface of the inner chute 42 is curved such that it slightly protrudes from the front side toward the rear side.

An end portion of the inner chute 42 closest to the switchback roller 34, that is, a downstream end of the inner chute 42 in the sheet ejection direction, is referred to as an inner chute end 42E.

As shown in FIG. 3, a distance L2 between the inner chute end 42E and the end portion of each second guide surface 59 closest to the switchback roller 34 is greater than a distance L1 between the inner chute end 42E and the end portion of each first guide surface 58 closest to the switchback roller 34. When viewed upstream from a position where the first guide surface 58 overlaps the second guide surface 59, that is, when viewed upstream from the intersection point H, in the switchback direction along the tangent T, a distance between the inner chute end 42E and the second guide surface 59 is greater than a distance between the inner chute end 42E and the first guide surface 58.

As shown in FIG. 1, the rear opening 43 is disposed through the rear wall of the main casing 2 in the front-rear direction.

The rear cover 44 is shaped like a rectangular flat plate, in a rear view, defining an outline of the rear end portion of the main casing 2. The rear cover 44 includes, on its front surface, a plurality of ribs, which extend in the vertical direction and are spaced apart from each other in the left-right direction. The front surfaces of the ribs of the rear cover 44 are curved such that they are slightly recessed from the front side toward the rear side. Specifically, the front surfaces of the ribs of the rear cover 44 are curved to have substantially the same curvature radius as that of the rear surface of the inner chute 42.

The rear cover 44 is configured to pivot between a closed position where the rear opening 43 is closed, as shown by the solid line in FIG. 1, and an open position where the rear opening 43 is open, as shown by the phantom line in FIG. 1.

A plurality of, e.g., two, pairs of reverse feed rollers 45 are disposed between the sheet supply unit 3 and the image forming unit 4 and spaced apart from each other in the front-rear direction.

To change a feed direction of the sheet P from the sheet ejection direction to the switchback direction, the rotation direction of the switchback roller 34 is changed after the rear end of the sheet P fed in the sheet ejection direction, that is, an upstream end of the sheet P fed in the sheet ejection direction, is fed to near a downstream end of the outer chute 41 in the sheet ejection direction.

The sheet P whose feed direction is changed from the sheet ejection direction to the switchback direction is guided toward between the inner chute 42 and the rear cover 44 by the outer chute 41.

The sheet P is guided by the rear cover 44 between the inner chute 42 and the rear cover 44 such that the sheet P makes a U-turn downward and frontward with the curvature radius greater than that of the ejection path 33.

A feed path extending downward from the lower end of the outer chute 41 such that the sheet P passes between the inner chute 42 and the rear cover 44 is referred to as a first reverse feed path 63 as an example of a re-feed path. In other words, the rear cover 44 and the inner chute 42 define a part of the first reverse feed path 63.

The outer chute 41 is disposed upstream of the rear cover 44 in the switchback direction.

The fixing unit 17 and the switchback roller 34 are disposed to one side, e.g., a front side, of the inner chute 42, while the first reverse feed path 63 is provided to the other side, e.g., a rear side, of the inner chute 42.

The sheet P having passed through the first reverse feed path 63 is fed between the pairs of reverse feed rollers 45 from the rear side toward the front side, makes a U-turn upward and rearward in a position at the front of the main body-side register roller 24 and the process-side register roller 25 and also at the rear of the sheet supply path 14, and then is fed between the main body-side register roller 24 and the process-side register roller 25.

A feed path extending in the switchback direction from the downstream end of the first reverse feed path 63 to between the main body-side register roller 24 and the process-side register roller 25 is referred to as a second reverse feed path 64.

The sheet P is corrugated in the left-right direction when passing between the switchback roller 34 and the corrugation rollers 35, regardless of whether the feed direction is the sheet ejection direction or the switchback direction.

Specifically, as shown in FIG. 3, when the sheet P passes between the switchback roller 34 and the corrugation rollers 35, the sheet P is fed while it is sandwiched at the nip positions N between the switchback roller main bodies 48 and the corresponding corrugation roller main bodies 51.

At this time, on the left side of the nip position N on the first corrugation roller 35A in the left-right direction, the sheet P is fed such that the sheet P is carried on the top of the corrugation part 52 of the first corrugation roller 35A.

In a distance between the nip position N on the first corrugation roller 35A and the nip position N on the second corrugation roller 35B in the left-right direction, the sheet P is fed such that the sheet P is substantially flush with the nip positions N in the vertical direction as there is no component to interfere with the sheet P being fed.

In a distance between the nip position N on the second corrugation roller 35B and the nip position N on the third corrugation roller 35C in the left-right direction, the sheet P is fed such that the sheet P is carried on the top of the corrugation part 52 of the second corrugation roller 35B and on the top of the corrugation part 52 of the third corrugation roller 35C.

In a distance between the nip position N on the third corrugation roller 35C and the nip position N on the fourth corrugation roller 35D in the left-right direction, the sheet P is fed such that the sheet P is substantially flush with the nip positions N in the vertical direction as there is no component to interfere with the sheet P being fed.

On the right side of the nip position N on the fourth corrugation roller 35D in the left-right direction, the sheet P is fed such that the sheet P is carried on the top of the corrugation part 52 of the fourth corrugation roller 35D.

Thus, the sheet P protrudes relatively upward at three portions corresponding to the left side of the nip position N on the first corrugation roller 35A, the distance between the nip position N on the second corrugation roller 35B and the nip position N on the third corrugation roller 35C, and the right side of the nip position N on the fourth corrugation roller 35D in the left-right direction. The portions of the sheet P protruding upward are referred to as ridge portions PH.

The sheet P protrudes relatively downward at two portions corresponding to the distance between the nip position N on the first corrugation roller 35A and the nip position N on the second corrugation roller 35B, and the distance between the nip position N on the third corrugation roller 35C and the nip position N on the fourth corrugation roller 35D in the left-right direction. The portions of the sheet P protruding downward are referred to as groove portions PL.

Thus, the sheet P is corrugated with the ridge portions PH and the groove portions PL formed alternately in the left-right direction. In other words, when viewed in the left-right direction, the sheet P has the groove portions PL at portions each corresponding to a side of the nip position N on the corrugation roller 35 where the corrugation part 52 is not disposed, while the sheet P has the ridge portions PH at portions each corresponding to a side of the nip position N on the corrugation roller 35 where the corrugation part 52 is disposed.

It is noted that: when corrugation of the ridge portions PH and the groove portions PL is produced in a sheet P, stiffness is given to the sheet P; when the amplitude of the corrugation in the sheet P is great, stiffness of the sheet P is strong or the sheet P has increased stiffness; and when the amplitude of the corrugation in the sheet P is small, stiffness of the sheet P is weak or the sheet P has reduced stiffness.

When the sheet P is fed between the switchback roller 34 and the corrugation rollers 35 in the sheet ejection direction, the stiffness of the sheet P is increased. The sheet P having the increased stiffness can be prevented from being curled when ejected onto the ejection tray 36. Thus, a succeeding sheet P can be ejected and neatly stacked on the sheet P ejected onto the ejection tray 36.

When the sheet P is fed in the switchback direction between the switchback roller 34 and the corrugation rollers 35, the sheet P having the increased stiffness goes downward while curving rearward such that the sheet P is fed rearward along the tangent T without going back to the ejection path 33. The sheet P being fed rearward along the tangent T contacts the outer chute 41 in proximity to the intersection point H and the outer chute 41 guides the sheet P to the first reverse feed path 63.

Figure 4:
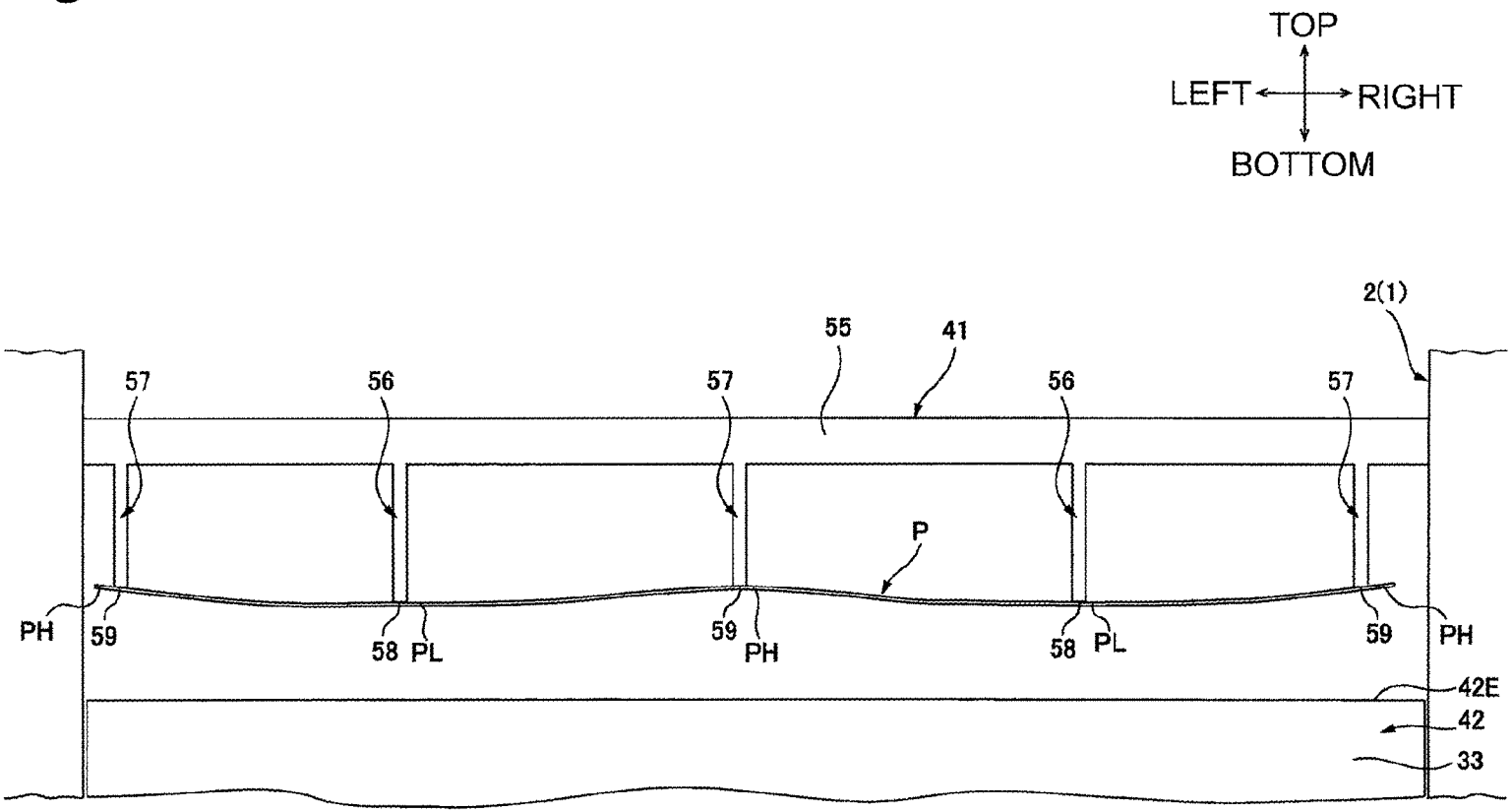
FIG. 4 is a view taken along the line B-B of FIG. 2, illustrating the state of the sheet being fed, continuing from the state in FIG. 3, wherein a sub chute is omitted for convenience sake.

As shown in FIG. 4, when the sheet P, fed in the switchback direction by changing the rotational direction of the switchback roller 34, is guided by the outer chute 41, the groove portions PL in the downstream end of the sheet P in the switchback direction contact the first guide surface 58 and the ridge portions PH therein contact the second guide surface 59.

Specifically, as shown in FIG. 3, the sheet P has the groove portions PL at the portions each corresponding to the side of the nip position N on the corrugation roller 35 where the corrugation part 52 is not disposed, while the sheet P has the ridge portions PH at the portions each corresponding to the side of the nip position N on the corrugation roller 35 where the corrugation part 52 is disposed.

As described above, the first ribs 56 are disposed, in the left-right direction, between the first corrugation roller 35A and the second corrugation roller 35B and between the third corrugation roller 35C and the fourth corrugation roller 35D, respectively. That is, the first ribs 56 are each disposed, in the left-right direction, closer to a portion of the corrugation roller 35 where the corrugation part 52 is not disposed than the nip position N on the corrugation roller 35. Thus, when the sheet P is guided by the outer chute 41, the groove portions PL of the sheet P contact the first guide surface 58 because the first ribs 56 are disposed in positions corresponding to the groove portions PL.

The second ribs 57 are disposed, in the left-right direction, to the left of the first corrugation roller 35A, between the second corrugation roller 35B and the third corrugation roller 35C, and to the right of the fourth corrugation roller 35D, respectively. That is, the second ribs 57 are each disposed, in the left-right direction, closer to the corrugation part 52 of the corrugation roller 35 than the nip position N on the corrugation roller 35. Thus, when the sheet P is guided by the outer chute 41, the ridge portions PH of the sheet P contact the second guide surface 59 because the second ribs 57 are disposed in positions corresponding to the ridge portions PH.

When the sheet P contacts the outer chute 41, the groove portions PL and the ridge portions PH contact the first guide surface 58 the second guide surface 59 respectively, substantially concurrently. In other words, as the sheet P contacts the outer chute 41 at plural points, the load on the sheet P can be distributed.

When projected in the axial direction of the switchback roller 34, the first guide surface 58 and the second guide surface 59 approach each other toward the downstream side in the switchback direction.

Figure 5:
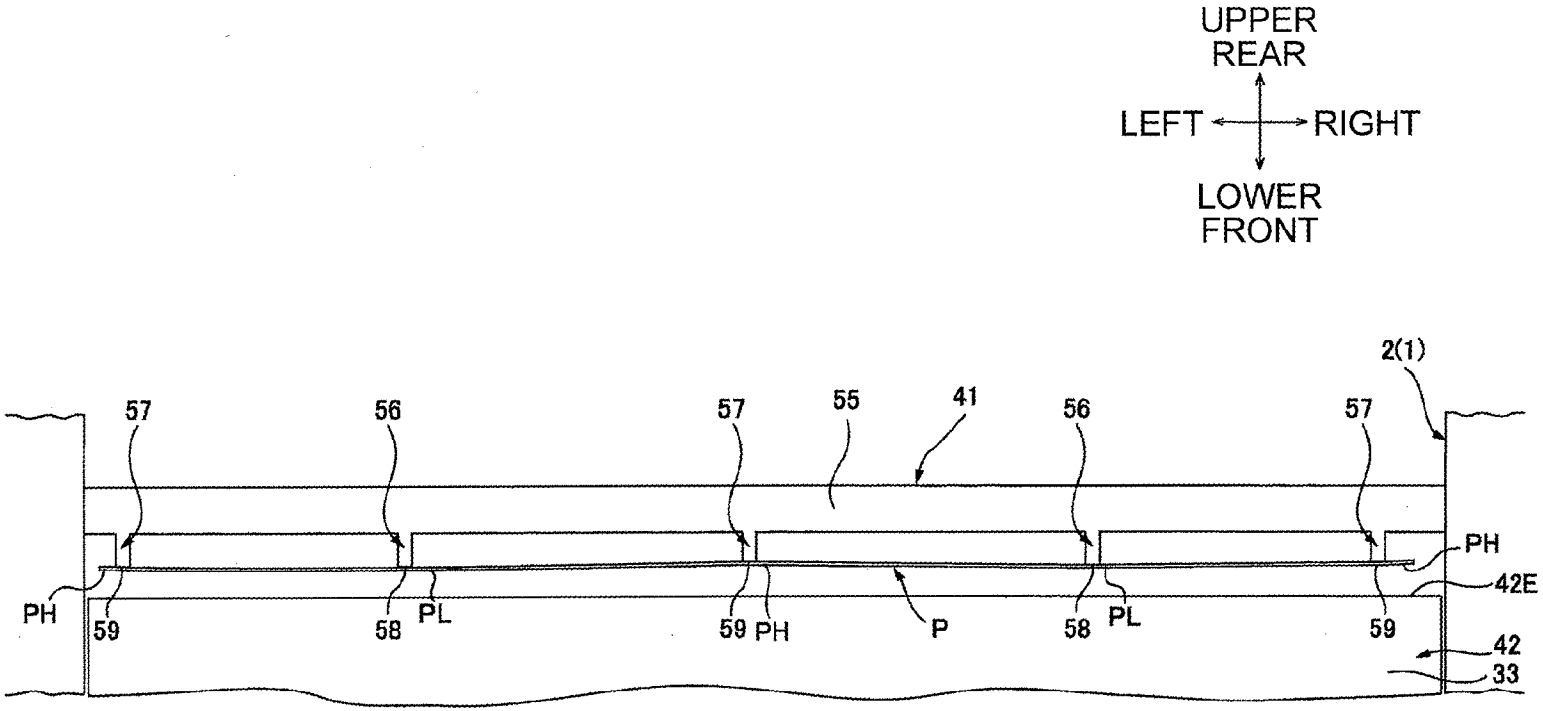
FIG. 5 is a view taken along the line C-C of FIG. 2, illustrating the state of the sheet being fed, continuing from the state in FIG. 4.

The sheet P is fed rearward such that the sheet P contacts the outer chute 41. As the first guide surface 58 and the second guide surface 59 get closer to each other when projected in the axial direction of the switchback roller 34, the amplitude of the corrugation of the sheet P having the groove portions PL that contact the first guide surface 58 and the ridge portions PH that contact the second guide surface 59 becomes small by a force applied to the sheet P being fed rearward and the stiffness of the sheet P gets weak. That is, as shown in FIG. 5, the sheet P becomes substantially flat.

As shown in FIG. 1, the sheet P passes through the first reverse feed path 63 and the second reverse feed path 64 and is fed to the image forming unit 4 again to have an image formed on the other side of the sheet P.

According to the printer 1, the sheet P having an image on one side thereof formed by the image forming unit 4 is guided by the inner chute front surface 42F and the outer chute 41 in this order such that the sheet P is fed toward between the switchback roller 34 and the corrugation rollers 35 in the sheet ejection direction as shown in FIG. 2.

At this time, the sheet P being fed between the switchback roller 34 and the corrugation rollers 35 is corrugated to have the groove portions PH and the ridge portions PH formed by the corrugation rollers 35 as shown in FIG. 3 such that the stiffness of the sheet P is increased.

As shown in FIG. 2, the feed direction of the sheet P is changed from the sheet ejection direction to the switchback direction by changing the rotational direction of the switchback roller 34 such that the sheet P is fed in the switchback direction, and the sheet P having the increased stiffness is guided by the outer chute 41 and fed to the image forming unit 4 again.

As shown in FIG. 3, as viewed from the downstream side of the switchback roller 34 in the sheet ejection direction along the tangent T, the outer chute 41 has the first guide surfaces 58 and the second guide surfaces 59, which have different distances L1 and L2 from the inner chute end 42E. Thus, the sheet P is corrugated to have the groove portions PL and the ridge portions PH and the stiffness of the sheet P is increased. Even if the sheet P having the increased stiffness contacts the outer chute 41, the groove portions PL and the ridge portions PH formed in the sheet P can prevent the load on the sheet P from being concentrated in one place.

Thus, the resistance to the sheet P fed to the first reverse feed path 63 can be reduced.

As a result, with a simple structure that the outer chute 41 has the first guide surfaces 58 and the second guide surfaces 59, problems due to the resistance to the sheet P being fed, such as noise caused when resistance is applied to the sheet, bending of the sheet P, and jamming in the main casing 2 can be reduced.

According to the printer 1, as shown in FIG. 2, the sheet P having the groove portions PL and the ridge portions PH is guided by the outer chute 41 having the first guide surfaces 58 and the second guide surfaces 59, which have different curvature radii, and then fed to the first reverse feed path 63. As the sheet P having the increased stiffness is fed in the switchback direction along the tangent T of the switchback roller 34 at the nip position N, the sheet P is brought in contact with the outer chute 41 reliably. The first guide surfaces 58 and the second guide surfaces 59 have curvature radii such that, when projected in the left-right direction, the first guide surfaces 58 and the second guide surfaces 59 overlap each other on the downstream side in the switchback direction of the intersection point H of the outer chute 41 and the tangent T. Thus, the first guide surfaces 58 and the second guide surfaces 59 are closer to each other toward the downstream side in the switchback direction.

Thus, when projected in the left-right direction, the groove portions PL and the ridge portions PH are closer to each other toward the downstream side in the switchback direction. That is, the stiffness of the sheet P is reduced toward the downstream side in the switchback direction. As shown in FIG. 5, the sheet P becomes substantially flat.

As a result, as shown in FIG. 2, the sheet P is guided to the first reverse feed path 63 by the outer chute 41 while the resistance to the sheet P being fed is reduced. After the sheet P is guided to the first reverse feed path 63, the sheet P having the reduced stiffness passes through the second reverse feed path 64 and is re-fed toward the image forming unit 4.

That is, the sheet P having the increased stiffness can be guided to the first reverse feed path 63 reliably while the resistance to the sheet P is reduced. As the stiffness of the sheet P is reduced in the first reverse feed path 63, the sheet P can be stably fed toward the image forming unit 4.

According to the printer 1, as shown in FIG. 1, a part of the first reverse feed path 63 is defined by the rear cover 44, which is pivotable relative to the main casing 2. If the sheet P being fed in the switchback direction by the outer chute 41 is jammed in the first reverse feed path 63, the rear cover 44 is located in the open position shown by the phantom line in FIG. 1 to open the opening 43 and the jammed sheet P can be removed through the opening 43.

According to the printer 1, as shown in FIG. 3, the sheet P is corrugated to have the ridge portions PH at three portions corresponding to the left side of the nip position N on the first corrugation roller 35A, the distance between the nip position N on the second corrugation roller 35B and the nip position N on the third corrugation roller 35C, and the right side of the nip position N on the fourth corrugation roller 35D.

In addition, the sheet P is corrugated to have the groove portions PL at the two portions corresponding to the distance between the nip position N on the first corrugation roller 35A and the nip position N on the second corrugation roller 35B and the distance between the nip position N on the third corrugation roller 35C and the nip position N on the fourth corrugation roller 35D.

In the left-right direction, the first guide surfaces 58 are disposed corresponding to the groove portions PL which are to be formed at portions each corresponding to a side of the nip position N on the corrugation roller 35 where the corrugation part 52 is not disposed. In addition, the second guide surfaces 59 are disposed corresponding to the ridge portions PH which are to be formed at portions each corresponding to a side of the nip position N on the corrugation roller 35 where the corrugation part 52 is disposed.

When the sheet P being fed in the switchback direction contacts the outer chute 41, the distance between each groove portion PL and the corresponding first guide surface 58 and the distance between each ridge portion PH and the corresponding second guide surface 59 get closer relatively.

As a result, compared with a case where the outer chute 41 does not have the first guide surfaces 58 and the second guide surfaces 59, the sheet P having the groove portions PL and the ridge portions PH can be smoothly brought in contact with the outer chute 41 and thus the resistance to the sheet P being fed can be reduced.

According to the printer 1, as shown in FIG. 2, when the switchback roller 34 rotates in the backward direction to change the feed direction of the sheet P from the sheet ejection direction to the switchback direction, if the stiffness of the sheet P is not strong, the sheet P may be fed at the front of the inner chute 42 or fed back to the ejection path 33 in the switchback direction.

However, the corrugation rollers 35 produce the groove portions PL and the ridge portions PH in the sheet P such that the stiffness of the sheet P is increased. Thus, the sheet P fed from the switchback roller 34 in the switchback direction can be reliably fed to the first re-feed path 63 disposed at the rear of the inner chute 42

Thus, the sheet P can be reliably re-fed toward the image forming unit 4.

A second embodiment of the disclosure will be described with reference to FIGS. 6 and 7. It is noted that, in the second embodiment, elements similar to or identical with those shown in and described in the first embodiment are designated by similar numerals, and thus the description thereof can be omitted for the sake of brevity.

Figure 6:
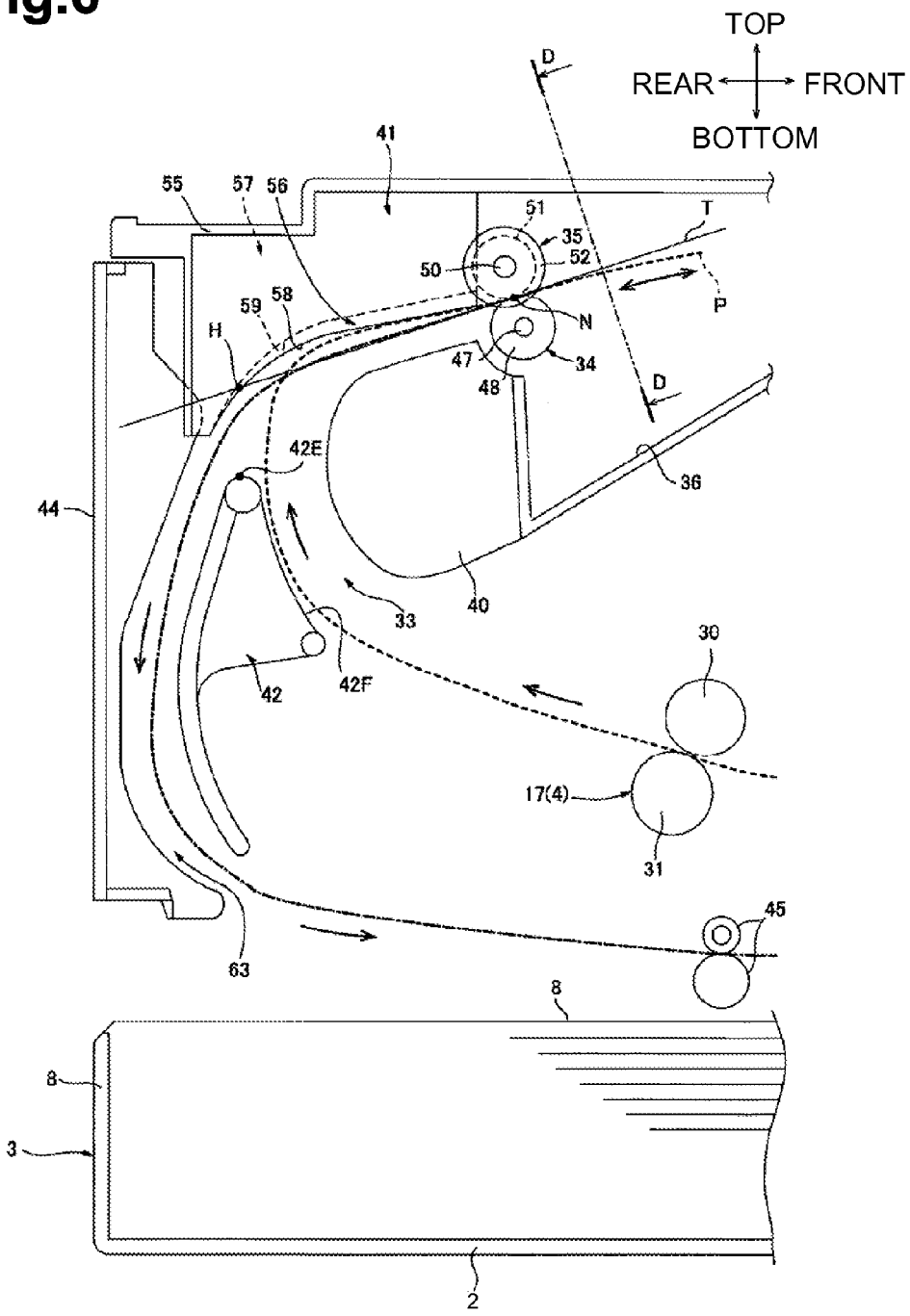
FIG. 6 is an enlarged view illustrating a principal part of a reverse feeding portion of a printer according to a second illustrative embodiment.
Figure 7:
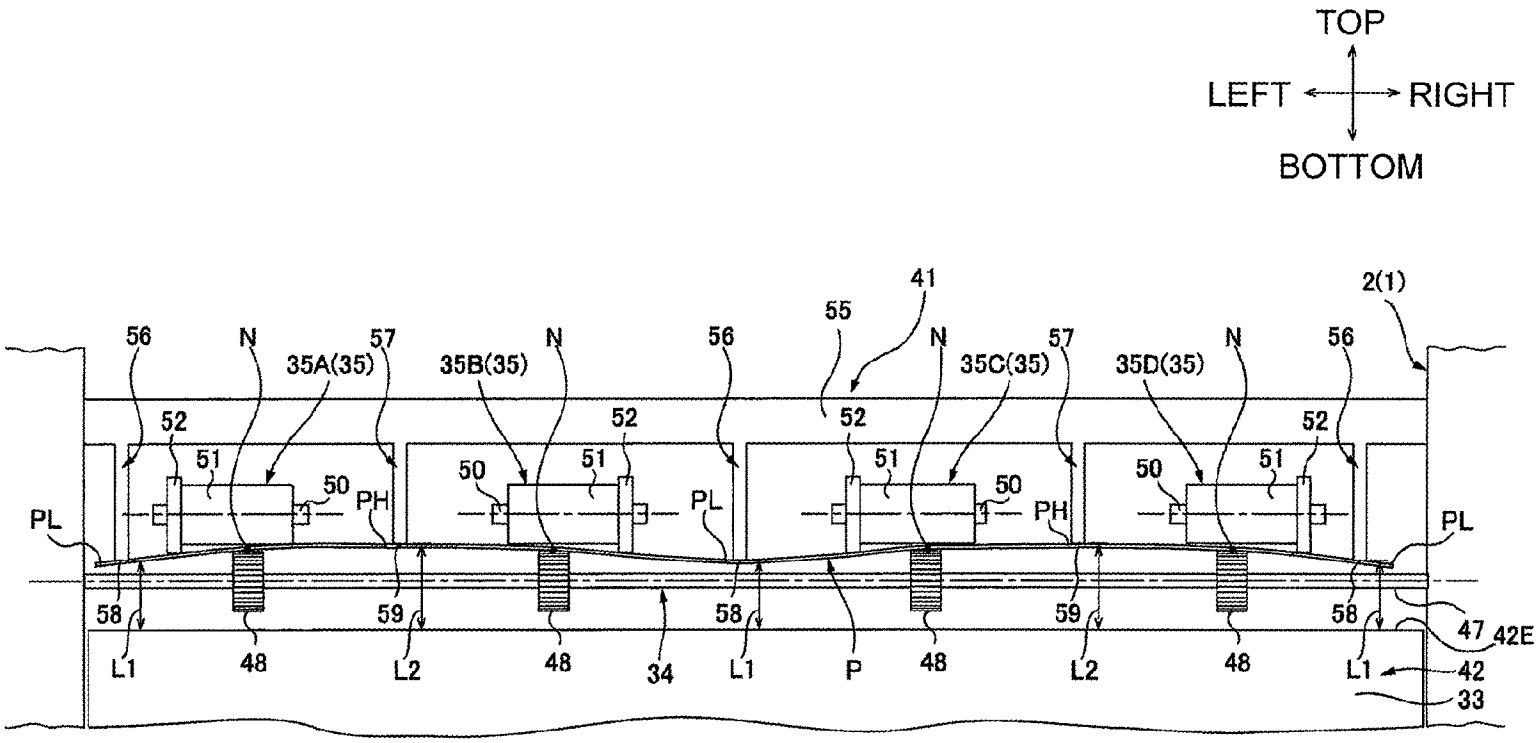
FIG. 7 is a view taken along the line D-D of FIG. 6, illustrating a state of a sheet being fed, wherein a sub chute is omitted for convenience sake.

As shown in FIGS. 6 and 7, the second embodiment illustrates that the main casing 2 includes the switchback roller 34 having a plurality of, e.g., four, switchback roller main bodies 48 and a plurality of, e.g., four, corrugation rollers 35 (35A to 35D) to be pressed against the upper ends of the corresponding switchback roller main bodies 48.

In the side view of FIG. 6, the corrugation part 52 of each corrugation roller 35 extends downward from above the tangent T to a portion of the corrugation part 52 that contacts the sheet P such that the corrugation part 52 lies above and below the tangent T.

As shown in FIG. 7, the outer chute 41 includes a plurality of, e.g., three, first ribs 56 and a plurality of, e.g., two, second ribs 57.

In the left-right direction, the left first rib 56 is disposed to the left of the first corrugation roller 35A, the middle first rib 56 is disposed between the second corrugation roller 35B and the third corrugation roller 35C, and the right first rib 56 is disposed to the right of the fourth corrugation roller 35D.

In the left-right direction, the left second rib 57 is disposed between the first corrugation roller 35A and the second corrugation roller 35B, and the right second rib 57 is disposed between the third corrugation roller 35C and the fourth corrugation roller 35D.

When the sheet P having corrugation of the groove portions PL and the ridge portions PH in the left-right direction is fed in the switchback direction and guided by the outer chute 41, the groove portions PL of the sheet P contact the first guide surfaces 58 and the ridge portions PH of the sheet P contact the second guide surfaces 59.

When the sheet P contacts the outer chute 41, the groove portions PL and the ridge portions PH contact the first guide surface 58 the second guide surface 59 respectively, substantially concurrently. In other words, as the sheet P contacts the outer chute 41 at plural points, the load on the sheet P can be distributed.

Even with the second embodiment, it is clear that effects similar to those brought about by the first embodiment can be appreciated.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming unit configured to form an image on a sheet;

a first guide configured to guide the sheet having the image formed by the image forming unit;

a switchback roller configured to rotate in a forward direction in which the sheet is ejected in a sheet ejection direction and in a backward direction in which the sheet is fed in a switchback direction;

a second guide configured to guide the sheet guided by the first guide toward the switchback roller in the sheet ejection direction, the second guide being further configured to guide the sheet being fed in the switchback direction from the switchback roller toward a re-feed path for re-feeding the sheet toward the image forming unit; and a corrugation member including a nip portion configured to contact the switchback roller and a protruding portion protruding toward the switchback roller relative to the nip portion, the corrugation member having a shape for producing, in the sheet being fed, a recessed portion and a ridge portion as viewed from a downstream side of the switchback roller in the sheet ejection direction along a tangent to the switchback roller at a nip position where the nip portion of the corrugation member and the switchback roller nip the sheet therebetween, wherein the second guide has:

a first guide surface disposed to contact the recessed portion of the sheet fed in the switchback direction; and a second guide surface spaced apart from the first guide surface at least in an axial direction of the switchback roller, the second guide surface being disposed to contact the ridge portion of the sheet fed in the switchback direction, wherein, as viewed from the downstream side of the switchback roller in the sheet ejection direction along the tangent to the switchback roller at the nip position, a distance between an end of the first guide closest to the switchback roller and an end of the second guide surface closest to the switchback roller is greater than a distance between the end of the first guide closest to the switchback roller and an end of the first guide surface closest to the switchback roller, and wherein the second guide includes a first rib having the first guide surface and a second rib having the second guide surface.

2. The image forming apparatus according to claim 1, further comprising:

a main body; and a cover configured to be closed and open relative to the main body, wherein the cover defines a part of the re-feed path, and wherein the second guide is disposed upstream of the cover in the switchback direction.

3. The image forming apparatus according to claim 1, wherein, as viewed from the downstream side of the switchback roller in the sheet ejection direction along the tangent to the switchback roller at the nip position, the nip position is closer in a perpendicular direction to a downstream end, in the sheet ejection direction, of the first guide than the protruding portion of the corrugation member is, and the first guide surface of the second guide is disposed closer to the nip position than the protruding portion of the corrugation member, wherein the perpendicular direction is perpendicular to both the axial direction of the switchback roller and the tangent to the switchback roller at the nip position.

4. The image forming apparatus according to claim 1, wherein, as viewed from the downstream side of the switchback roller in the sheet ejection direction along the tangent to the switchback roller at the nip position, the protruding portion of the corrugation member is closer in a perpendicular direction to a downstream end, in the sheet ejection direction, of the first guide than the nip position is, and the first guide surface of the second guide is disposed closer to the protruding portion of the corrugation member than the nip position, wherein the perpendicular direction is perpendicular to both the axial direction of the switchback roller and the tangent to the switchback roller at the nip position.

5. The image forming apparatus according to claim 1, further comprising a fixing unit configured to fix the image onto the sheet, wherein the fixing unit and the switchback roller are disposed on one side of the first guide and the re-feed path is provided on the other side of the first guide, wherein the first guide and the second guide are configured to guide the sheet having the image fixed by the fixing unit such that the sheet makes a turn toward the switchback roller, and wherein the second guide is configured to guide the sheet fed from the switchback roller in the switchback direction such that the sheet makes a turn toward the re-feed path.

6. The image forming apparatus according to claim 1, further comprising a particular corrugation member spaced apart from the corrugation member in the axial direction of the switchback roller, wherein the first guide surface of the second guide is disposed between the corrugation member and the particular corrugation member in the axial direction of the switchback roller.

7. The image forming apparatus according to claim 6, wherein the particular corrugation member includes a nip portion configured to contact the switchback roller and a protruding portion protruding toward the switchback roller relative to the nip portion, and wherein, as viewed from the downstream side of the switchback roller in the sheet ejection direction along the tangent to the switchback roller at the nip position, a first distance between the nip portion of the corrugation member and the nip portion of the particular corrugation member is greater in the axial direction of the switchback roller than a second distance between the protruding portion of the corrugation member and the protruding portion of the particular corrugation member.

8. The image forming apparatus according to claim 6, wherein the particular corrugation member includes a nip portion configured to contact the switchback roller and a protruding portion protruding toward the switchback roller relative to the nip portion, and wherein, as viewed from the downstream side of the switchback roller in the sheet ejection direction along the tangent to the switchback roller at the nip position, a first distance between the nip portion of the corrugation member and the nip portion of the particular corrugation member is smaller in the axial direction of the switchback roller than a second distance between the protruding portion of the corrugation member and the protruding portion of the particular corrugation member.

9. The image forming apparatus according to claim 1, further comprising a particular corrugation member spaced apart from the corrugation member in the axial direction of the switchback roller, and wherein the second guide surface of the second guide is disposed between the corrugation member and the particular corrugation member in the axial direction of the corrugation member and the particular corrugation member.

10. The image forming apparatus according to claim 9, wherein the particular corrugation member includes a nip portion configured to contact the switchback roller and a protruding portion protruding toward the switchback roller relative to the nip portion, and wherein, as viewed from the downstream side of the switchback roller in the sheet ejection direction along the tangent to the switchback roller at the nip position, a first distance between the nip portion of the corrugation member and the nip portion of the particular corrugation member is smaller in the axial direction of the switchback roller than a second distance between the protruding portion of the corrugation member and the protruding portion of the particular corrugation member.

11. The image forming apparatus according to claim 9, wherein the particular corrugation member includes a nip portion configured to contact the switchback roller and a protruding portion protruding toward the switchback roller relative to the nip portion, and wherein, as viewed from the downstream side of the switchback roller in the sheet ejection direction along the tangent to the switchback roller at the nip position, a first distance between the nip portion of the corrugation member and the nip portion of the particular corrugation member is greater in the axial direction of the switchback roller than a second distance between the protruding portion of the corrugation member and the protruding portion of the particular corrugation member.

12. An image forming apparatus comprising:

an image forming unit configured to form an image on a sheet;

a first guide configured to guide the sheet having the image formed by the image forming unit;

a switchback roller configured to rotate in a forward direction in which the sheet is ejected in a sheet ejection direction and in a backward direction in which the sheet is fed in a switchback direction;

a second guide configured to guide the sheet guided by the first guide toward the switchback roller in the sheet ejection direction, the second guide being further configured to guide the sheet being fed in the switchback direction from the switchback roller toward a re-feed path for re-feeding the sheet toward the image forming unit; and a corrugation member including a nip portion configured to contact the switchback roller and a protruding portion protruding toward the switchback roller relative to the nip portion, the corrugation member having a shape for producing, in the sheet being fed, a recessed portion and a ridge portion as viewed from a downstream side of the switchback roller in the sheet ejection direction along a tangent to the switchback roller at a nip position where the nip portion of the corrugation member and the switchback roller nip the sheet therebetween, wherein the second guide has:

a first guide surface disposed to contact the recessed portion of the sheet fed in the switchback direction; and a second guide surface spaced apart from the first guide surface at least in an axial direction of the switchback roller, the second guide surface being disposed to contact the ridge portion of the sheet fed in the switchback direction, wherein, as viewed from the downstream side of the switchback roller in the sheet ejection direction along the tangent to the switchback roller at the nip position, a distance between an end of the first guide closest to the switchback roller and an end of the second guide surface closest to the switchback roller is greater than a distance between the end of the first guide closest to the switchback roller and an end of the first guide surface closest to the switchback roller, wherein a curvature radius of the second guide surface is greater than a curvature radius of the first guide surface, and wherein, when projected in the axial direction of the switchback roller, the first guide surface and the second guide surface overlap each other on a downstream side, in the switchback direction, of an intersection point of the second guide and the tangent to the switchback roller at the nip position.

* * * * *